US006431341B1

(12) United States Patent
Tsuji et al.

(10) Patent No.: US 6,431,341 B1
(45) Date of Patent: Aug. 13, 2002

(54) COIN DISCRIMINATING APPARATUS

(75) Inventors: Keiji Tsuji; Masataka Takahashi, both of Chiba (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 0 days.

(21) Appl. No.: 09/568,306

(22) Filed: May 9, 2000

(30) Foreign Application Priority Data

May 24, 1999 (JP) ..... 11-142667

(51) Int. Cl.[7] ..... G07D 5/08
(52) U.S. Cl. ..... 194/317
(58) Field of Search ..... 194/317, 328, 194/330, 334

(56) References Cited

U.S. PATENT DOCUMENTS 5,650,863 A 7/1997 Utagawa et al.
6,328,150 B1 * 12/2001 Hibari ..... 194/317

FOREIGN PATENT DOCUMENTS

EP 0 533 386 A1 3/1993
EP 0 683 473 A2 11/1995

OTHER PUBLICATIONS

Patent Abstracts of Japan; vol. 1998, No. 06; Apr. 30, 1998 & JP 10 049654 A (Glory Ltd; Copal Ltd), Feb. 20, 1998.

* cited by examiner

*Primary Examiner*—Donald P. Walsh
*Assistant Examiner*—Mark J Beauchaine
(74) *Attorney, Agent, or Firm*—Cohen, Pontani, Lieberman & Pavane

(57) ABSTRACT

A coin discriminating apparatus includes a light source for emitting light toward one surface of a coin being transported, a reflected light sensor for receiving light emitted from the light source and reflected by the coin, light emitting elements disposed downstream of the light source for emitting light toward the one surface of the coin being transported, a sensor for photoelectrically receiving light emitted from the light emitting elements and reflected by the one surface of the coin and producing image pattern data of the one surface of the coin, a memory for storing reference data of coins of each denomination, a first denomination discriminator for calculating coin diameter based on the image pattern data of the one surface of the coin produced by the sensor, comparing it with reference diameter data of coins of each denomination stored in the memory and tentatively determining the denomination of the coin, a second denomination discriminator for reading reference pattern data of coins of the denomination determined by the first denomination discriminator from the memory, comparing the reference pattern data with the image pattern data of the one surface of the coin and finally determining the denomination of the coin, and a received light amount controller for controlling an amount of light reflected by the one surface of the coin to be detected by the sensor in accordance with an amount of light reflected by the coin and detected by the reflected light sensor. According to the thus constituted coin discriminating apparatus, it is possible to discriminate whether or not coins are acceptable and the denominations of coins with high accuracy by optically detecting the surface patterns of coins.

10 Claims, 4 Drawing Sheets

COIN DISCRIMINATING APPARATUS

BACKGROUND OF THE INVENTION

The present invention relates to a coin discriminating apparatus and, particularly, such an apparatus capable of discriminating whether or not coins are acceptable and the denominations of coins with high accuracy by optically detecting the surface patterns of coins.

DESCRIPTION OF THE PRIOR ART

Conventionally, discrimination of whether or not coins are acceptable, namely, whether coins are genuine or counterfeit and whether or not coins are current coins is conducted by detecting the diameters, materials, thickness and the like of coins. However, a coin discriminating apparatus for discriminating coins by optically detecting coin surface patterns has been recently proposed in order to improve discriminating accuracy.

For example, Japanese Patent Application Laid-Open No. 8-36661 teaches a coin discriminating apparatus which optically detects the surface pattern of a coin using a CCD area sensor and compares the detected pattern with reference patterns, thereby discriminating the denomination of the coin and whether or not the coin is acceptable.

However, when a coin is made of a material having high light reflectivity such as nickel, aluminum or the like, the total amount of light detected by the CCD area sensor becomes large and saturated if a large amount of light is projected onto the coin and, as a result, it becomes difficult to accurately produce the surface pattern of the coin by detecting light reflected from the surface of the coin. On the other hand, when a coin is made of a material having low light reflectivity such as copper, brass or the like, the amount of light reflected from the coin is too small if a small amount of light is projected onto the coin and, it becomes difficult to accurately produce the surface pattern of the coin. Therefore, this coin discriminating apparatus taught by this laid-open patent application is constituted so as to be able to accurately detect the image pattern of the coin irrespective of the material of the coin by controlling the intensity of light emitted from the light emitting elements or controlling the time period during which the CCD area sensor detects light reflected from the coin based on magnetic properties of the coin.

However, even when a coin is made of a material having high light reflectivity such as nickel, aluminum or the like, the amount of light reflected from the coin is small if the coin is damaged and, on the other hand, even when a coin is made of a material having low light reflectivity such as copper, brass or the like, the amount of light reflected from the coin is large if the coin is a newly issued one. Therefore, when the intensity of light or the light receiving time of the CCD area sensor is controlled in the above described manner, in a case where a coin made of a material having high light reflectivity such as nickel, aluminum or the like is damaged, the amount of light is too small to accurately detect the image pattern of the coin and, on the other hand, in a case where a coin made of a material having low light reflectivity such as copper, brass or the like is a newly issued one, the total amount of light detected by the CCD area sensor is large and saturated, whereby it becomes difficult to accurately produce the surface pattern of the coin by detecting light reflected by the surface of the coin.

SUMMARY OF THE INVENTION

It is therefore an object of the present invention to provide a coin discriminating apparatus capable for discriminating whether or not coins are acceptable and the denomination of coins with high accuracy by optically detecting the surface patterns of coins.

The above and other objects of the present invention can be accomplished by a coin discriminating apparatus including a light source for emitting light toward one surface of a coin being transported, reflected light sensor means for receiving light emitted from the light source and reflected by the coin, light emitting means disposed downstream of the light source with respect to a transportation direction of the coin for emitting light toward the one surface of the coin being transported, sensor means for photoelectrically receiving light emitted from the light emitting means and reflected by the one surface of the coin and producing image pattern data of the one surface of the coin, reference data storing means for storing reference data of coins of each denomination, first denomination determining means for calculating coin diameter based on the image pattern data of the one surface of the coin produced by the sensor means, comparing the thus calculated diameter of the coin with reference diameter data of coins of each denomination stored in the reference data storing means and tentatively determining the denomination of the coin, denomination discriminating means for reading reference pattern data of coins of the denomination determined by the first denomination determining means from the reference data storing means, comparing the thus read reference pattern data with the image pattern data of the one surface of the coin and finally determining the denomination of the coin, and received light amount control means for controlling an amount of light reflected by the one surface of the coin to be detected by the sensor means in accordance with an amount of light reflected by the coin and detected by the reflected light sensor means.

According to the present invention, the coin discriminating apparatus includes the received light amount control means for controlling the amount of light reflected by the one surface of the coin to be detected by the sensor means in accordance with the amount of light emitted from the light source, reflected by the coin and detected by the reflected light sensor means. Therefore, in the case where the coin is made of a material having high light reflectivity such as nickel, aluminum or the like, when the coin is damaged and the amount of light reflected from the coin is small, the amount of light reflected by the one surface of the coin to be detected by the sensor means can be controlled to become larger. On the other hand, in the case where the coin is made of a material having low light reflectivity such as copper, brass or the like, when the coin is a newly issued one and the amount of light reflected from the coin is large, the amount of light reflected by the one surface of the coin to be detected by the sensor means can be controlled to become smaller. As a consequence, since the reflected light from the coin received by the sensor means can be reliably prevented from becoming too small and the total amount of light detected by the sensor means can be reliably prevented from becoming too large and saturated, it becomes possible to produce pattern data of the surface of a coin and discriminate whether or not the coin is acceptable and the denomination of the coin with high accuracy.

In a preferred aspect of the present invention, the received light amount control means is constituted so as to control the intensity of light emitted from the light emitting means in accordance with the amount of light reflected from the coin and detected by the reflected light sensor means.

According to this preferred aspect of the present invention, since the received light amount control means is constituted so as to control the intensity of light emitted from the light emitting means in accordance with the amount of light reflected from the coin and detected by the reflected light sensor means, in the case where the coin is made of a material having high light reflectivity such as nickel, aluminum or the like, when the coin is damaged and the amount of light reflected from the coin is small, the light emitting means can be controlled by the received light amount control means so that the amount of light reflected by the one surface of the coin to be detected by the sensor means becomes larger and, on the other hand, in the case where the coin is made of a material having low light reflectivity such as copper, brass or the like, when the coin is a newly issued one and the amount of light reflected from the coin is large, the light emitting means can be controlled by the received light amount control means so that the amount of light reflected by the one surface of the coin to be detected by the sensor means becomes smaller. Therefore, since the reflected light from the coin received by the sensor means can be reliably prevented from becoming too small and the total amount of light detected by the sensor means can be reliably prevented from becoming too large and saturated, it becomes possible to produce pattern data of the surface of a coin and discriminate whether or not the coin is acceptable and the denomination of the coin with high accuracy.

In a further preferred aspect of the present invention, the received light amount control means is constituted so as to control the light emitting means in such a manner that the intensity of light emitted therefrom can be controlled to a high level when the amount of light detected by the reflected light sensor means is small and that the intensity of light emitted therefrom can be controlled to a low level when the amount of light detected by the reflected light sensor means is large.

In another preferred aspect of the present invention, the received light amount control means is constituted so as to control a time period during which the sensor means photoelectrically detects light reflected by the one surface of the coin in accordance with the amount of light reflected from the coin and detected by the reflected light sensor means.

According to this preferred aspect of the present invention, since the received light amount control means is constituted so as to control the time period during which the sensor means photoelectrically detects light reflected by the one surface of the coin in accordance with the amount of light reflected from the coin and detected by the reflected light sensor means, in the case where the coin is made of a material having high light reflectivity such as nickel, aluminum or the like, when the coin is damaged and the amount of light reflected from the coin is small, the sensor means can be controlled by the received light amount control means so that it detects a larger amount of light reflected by the one surface of the coin and, on the other hand, in the case where the coin is made of a material having low light reflectivity such as copper, brass or the like, when the coin is newly issued and the amount of light reflected from the coin is large, the sensor means can be controlled by the received light amount control means so that it detects a smaller amount of light reflected by the one surface of the coin. Therefore, since the reflected light from the coin received by the sensor means can be reliably prevented from becoming too small and the total amount of light detected by the sensor means can be reliably prevented from becoming too large and saturated, it becomes possible to produce pattern data of the surface of a coin and discriminate whether or not the coin is acceptable and the denomination of the coin with high accuracy.

In a further preferred aspect of the present invention, the received light amount control means is constituted so as to control the sensor means in such a manner that the time period becomes longer when the amount of light detected by the reflected light sensor means is small and that the time period becomes shorter when the amount of light detected by the reflected light sensor means is large.

In further preferred aspect of the present invention, the coin discriminating apparatus further includes magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

According to this preferred aspect of the present invention, the coin discriminating apparatus further includes magnetic sensor means for detecting magnetic properties of the coin being transported and the received light amount control means is constituted so as to control the amount of light reflected by the one surface of the coin to be detected by the sensor means in accordance with an amount of light reflected by the coin and detected by the reflected light sensor means and the magnetic properties of the coin detected by the magnetic sensor means. Therefore, it is possible to more finely control the amount of light reflected by the one surface of the coin to be detected by the sensor.

The above and other objects and features of the present invention will become apparent from the following description made with reference to the accompanying drawings.

DESCRIPTION OF THE PREFERRED EMBODIMENT

Figure 1:
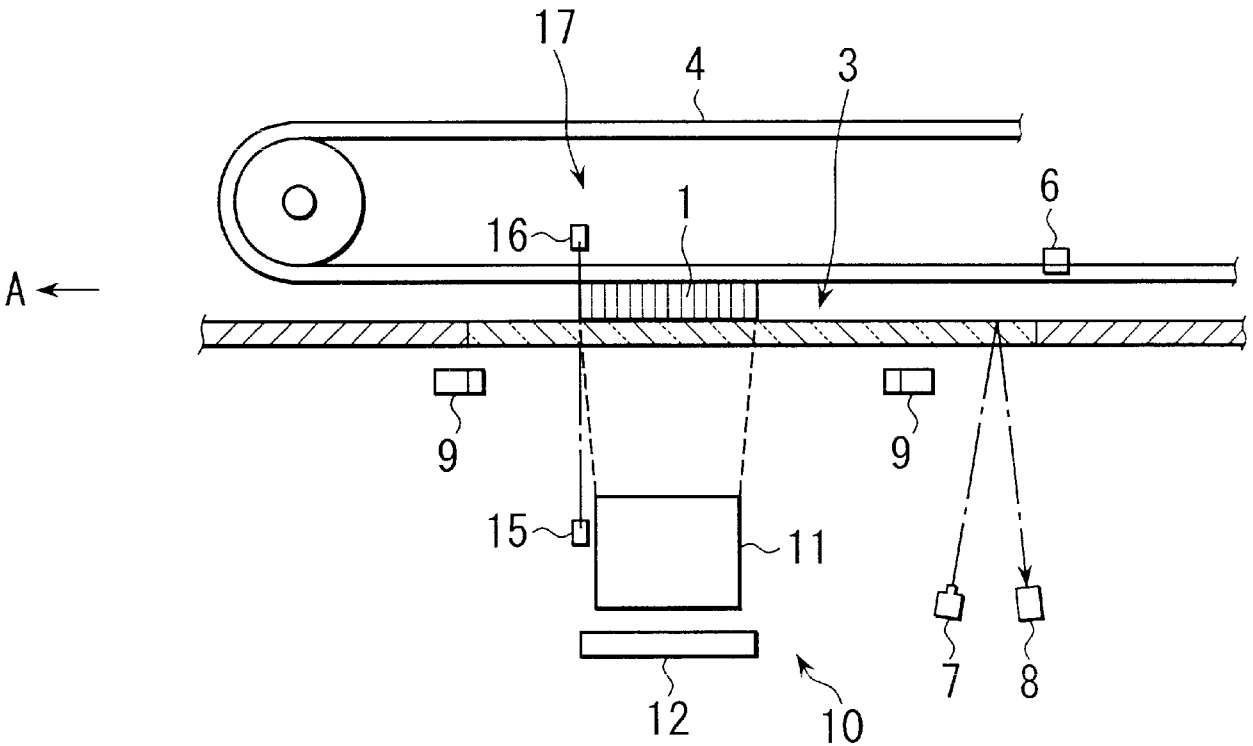
FIG. 1 is a schematic front view showing a coin discriminating apparatus which is a preferred embodiment of the present invention.
Figure 2:
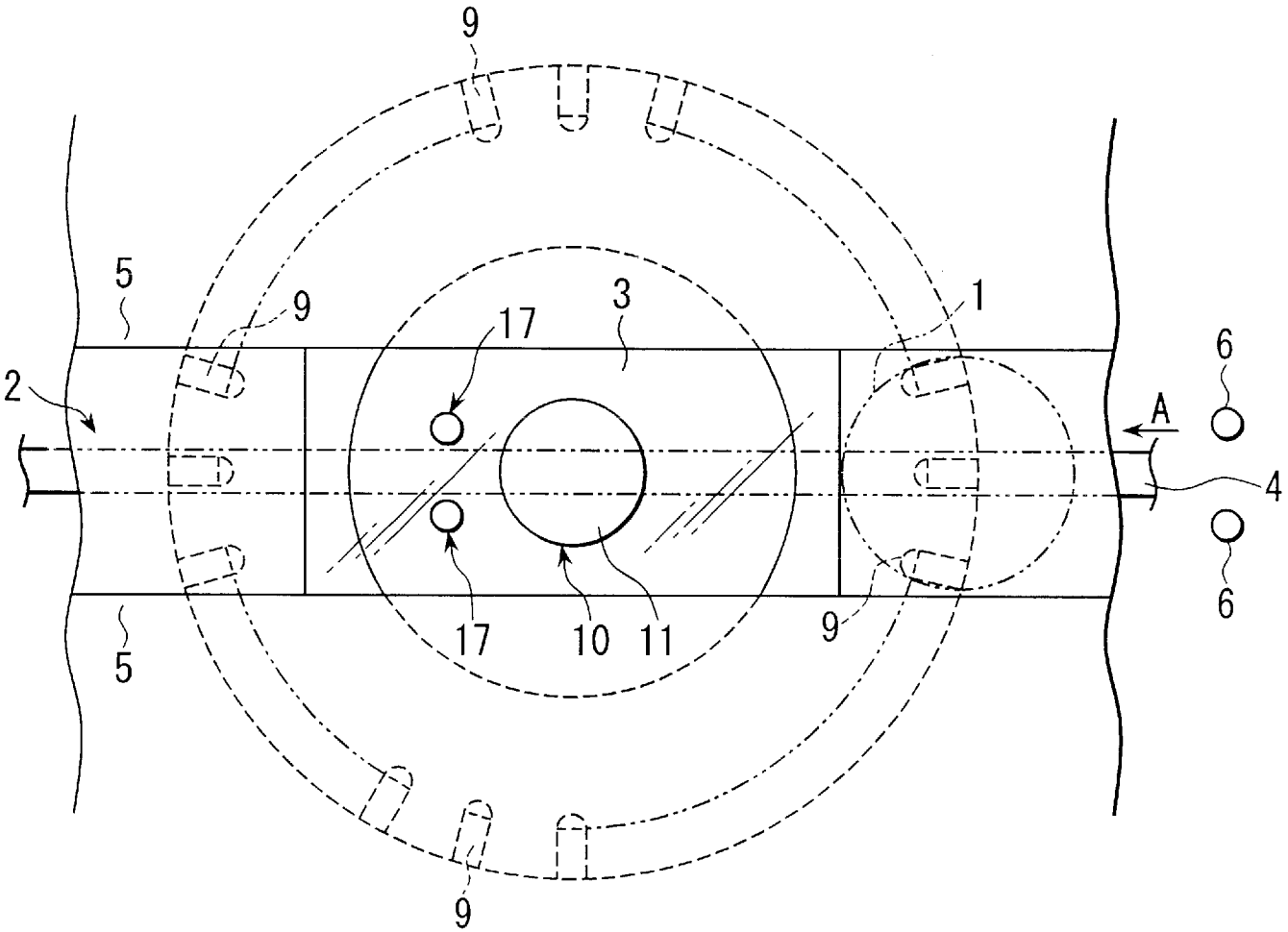
FIG. 2 is a schematic plan view showing a coin discriminating apparatus which is a preferred embodiment of the present invention.

As shown in FIGS. 1 and 2, a coin passage 2 through which coins 1 are transported is formed with a transparent passage portion 3 made of a transparent material such as glass, acrylic resin or the like.

A coin 1 is fed along a pair of guide rails 5, 5 in the direction indicated by an arrow A toward the transparent passage portion 3 in the coin passage 2. A pair of magnetic sensors 6, 6 are provided for detecting magnetic properties of the coin 1 upstream of the transparent passage portion 3 with respect to the transportation direction of the coin 1. At the transparent passage portion 3, the coin 1 is transported while being pressed onto the upper surface of the transparent passage portion 3 by a transporting belt 4.

Below the upstream end portion of the transparent passage portion 3, a light source 7 is provided for emitting light toward a part of the lower surface of the coin 1 on the transparent passage portion 3 and a single detection element type reflected light sensor 8 is provided for receiving light emitted from the light source 7 and reflected by a local region of the lower surface of the coin 1.

Below the transparent passage portion 3, are provided a plurality of light emitting elements 9 such as light emitting diodes (LEDs) for emitting light toward the coin 1 passing through the transparent passage portion 3. Below the light emitting elements 9, is provided an image data producing unit 10 for receiving emitted from the plurality of light emitting elements 9 and reflected by the coin 1 and producing corresponding image data.

As shown in FIG. 2, the plurality of light emitting elements 9 are disposed on a circle whose center is at the center portion of the transparent passage portion 3 and each light emitting element 9 is disposed in such a manner that the optical axis thereof is directed at a small angle with respect to the horizontal direction toward a predetermined point on a vertical axis passing through the center of a circle whose center coincides with the center portion of the transparent passage portion 3, whereby light is projected onto the coin 1 passing through the transparent passage portion 3 at a shallow angle with respect to the lower surface of the coin 1.

The image data producing unit 10 includes a lens system 11 disposed so that the optical axis thereof coincides with the vertical axis passing through the center of the circle whose center coincides with the center portion of the transparent passage portion 3, a CCD area sensor 12 disposed below the lens system 11 so that the focal point thereof is located on the upper surface of the transparent passage portion 3 and adapted for photoelectrically detecting light emitted from the light emitting elements 9 and reflected by the surface of the coin 1, and an A/D converter (not shown) for converting image data of the coin 1 photoelectrically detected by the CCD area sensor 12 into digital signals, thereby producing digitized image data of the coin 1.

On the immediate downstream side of the first image data producing unit 10, two timing sensors 17, 17, each of which includes a light emitting element 15 and a light receiving element 16, are provided so that light emitted from the light emitting element 15 can be detected through the first transparent passage portion 3 by the light receiving element 16 and each is constituted so as to output a timing signal when the light receiving element 16 does not receive light emitted from the light emitting element 15. Each of the timing sensors 17 is disposed with respect to the image data producing unit 10 so that the center of the coin 1 is located at the center of the transparent passage portion 3 when light emitted from the light emitting element 15 is blocked by the coin 1 being transported on the surface of the transparent passage portion 3 and is not received by the light receiving element 16, thereby outputting a timing signal.

Figure 3:
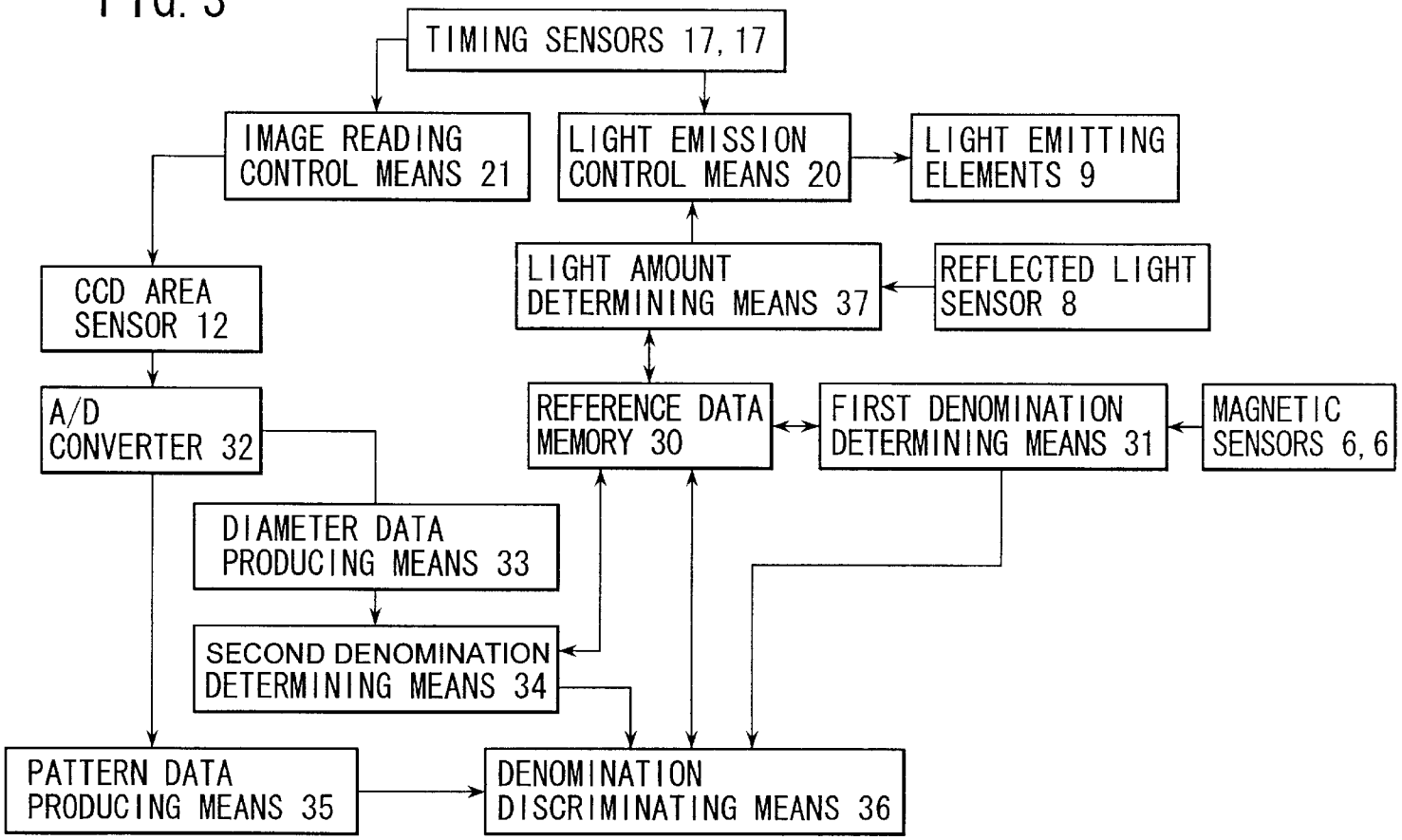
FIG. 3 is a block diagram of a detection system, a control system and a discrimination system of a coin discriminating apparatus which is a preferred embodiment of the present invention.

FIG. 3 is a block diagram of a detection system, a control system and a discrimination system of a coin discriminating apparatus which is a preferred embodiment of the present invention.

As shown in FIG. 3, the detection system of the coin discriminating apparatus includes the magnetic sensors 6, 6 for detecting magnetic properties of the coin 1, the single detection element type reflected light sensor 8 for receiving light emitted from the light source 7 and reflected by a local region of the lower surface of the coin 1 and the two timing sensors 17, 17 for detecting a coin 1 fed to the transparent passage portion 3.

As shown in FIG. 3, the control system of the coin discriminating apparatus includes light emission control means 20, which outputs a light emission signal to the plurality of light emitting elements 9 when the timing signal from the timing sensors 17, 17 is received and causes them to simultaneously emit light and illuminate the lower surface of the coin 1 located on the transparent passage portion 3. It is further includes image reading control means 21 for permitting the CCD area sensor 12 of the image data producing unit 10 to start detecting the light reflected from the lower surface of the coin 1 when the timing signal from the timing sensors 17, 17 is received.

As shown in FIG. 3, the discriminating system of the coin discriminating apparatus includes a reference data memory 30 for storing reference magnetic data, reference reflected light amount data, reference diameter data and reference surface pattern data of coins of each denomination, first denomination determining means 31 for comparing magnetic data of the coin 1 detected by the magnetic sensors 6, 6 with the reference magnetic data of coins of each denomination stored in the reference data memory 30 and tentatively determining the denomination of the coin 1, an A/D converter 32 for digitizing analog pattern data of the coin 1 obtained by the CCD area sensor 12 by photoelectrically detecting light emitted from the light emitting elements 9 and reflected by the coin 1, diameter data producing means 33 for producing diameter data of the coin 1 based on the pattern data of the coin 1 digitized by the A/D converter 32, second denomination determining means 34 for comparing the diameter data of the coin 1 produced by the diameter data producing means 33 with the reference diameter data of coins of each denomination stored in the reference data memory 30 and tentatively determining the denomination of the coin 1, pattern data producing means 35 for producing surface pattern data of the coin 1 based on the pattern data of the coin 1 digitized by the A/D converter 32, denomination discriminating means 36 for determining the denomination of the coin 1 based on a denomination determination signal input from the first denomination determining means 31 and on a denomination determination signal input from the second denomination determining means 34, reading the reference surface pattern data of coins of the thus determined denomination from the reference data memory 30, comparing the thus read reference surface pattern data with the surface pattern data of the coin 1 input from the pattern data producing means 35 and finally discriminating the denomination of the coin 1, and light amount determining means 37 for comparing reflected light amount data detected by the reflected light sensor 8 with the reference reflected light amount data stored in the reference data memory 30 and outputting a light amount determining signal to the light emission control means 20.

The thus constituted coin discriminating apparatus discriminates whether or not the coin 1 is acceptable and the denomination of the coin 1 in the following manner.

The coin 1 is fed in the coin passage 2 along the pair of guide rails 5, 5 in the direction indicated by the arrow A, while being pressed onto the surface of the coin passage 2 by the transporting belt 4, and the magnetic properties of the coin 1 are detected by the pair of magnetic sensors 6, 6.

When the magnetic sensors 6, 6 detect the magnetic properties of the coin 1, they output detection signals to the first denomination determining means 31. The first denomination determining means 31 compares the magnetic data of the coin 1 input from the magnetic sensors 6, 6 with the reference magnetic data of coins of each denomination stored in the reference data memory 30, determines the denomination of the coin 1 and outputs a denomination determination signal to the denomination discriminating means 36.

On the other hand, the light source 7 is maintained constantly on and when the coin 1 is fed to the transparent passage portion 3, a local region of the coin 1 is illuminated with light emitted from the light source 7. Light reflected by the illuminated part of the coin 1 is received by the reflected light sensor 8, which outputs a reflected light detection signal to the light amount determining means 37.

When the light amount determining means 37 receives the reflected light detection signal, it reads the reference reflected light amount data from the reference data memory 30 and compares the reflected light amount data of the coin 1 detected by the reflected light sensor 8 with the thus read reference reflected light amount data.

When the reflected light amount data of the coin 1 detected by the reflected light sensor 8 exceed the reference reflected light amount data, it can be judged either that the coin 1 is made of a material having high light reflectivity such as nickel, aluminum or the like and is not so damaged, or that the coin 1 has high light reflectivity despite being made of a material having low light reflectivity such as copper, brass or the like, because it has not been in circulation for a long time. Therefore, the light amount determining means 37 outputs a light amount determination signal instructing the light emission control means 20 to control the light amount emitted from the light emitting elements 9 to a low level.

On the other hand, when the reflected light amount data of the coin 1 detected by the reflected light sensor 8 are less than the reference reflected light amount data, it can be judged either that the coin has low light reflectivity despite being made of a material having high light reflectivity such as nickel, aluminum or the like, because it is damaged due to long circulation, or that the light reflectivity of the coin 1 is low since the coin 1 is made of a material having low light reflectivity such as copper, brass or the like and has been in circulation for a long time. Therefore, the light amount determining means 37 outputs a light amount determination signal instructing the light emission control means 20 to control the light amount emitted from the light emitting elements 9 to a high level.

When the coin 1 has reached the transparent passage portion 3 and the timing sensors 17, 17 detect the coin 1, timing signals are output to the light emission control means 20 and the image reading control means 21.

As a result, in accordance with the light amount determination signal input from the light amount determining means 37, the light emission control means 20 controls the light emitting elements and causes them to emit light such that the amount of light emitted therefrom becomes low or becomes high. At the same time, the image reading control means 21 causes the CCD area sensor 12 of the image data producing unit 10 to start detecting light reflected by the lower surface of the coin 1.

Since each light emitting element 9 is disposed so as to be able to illuminate the coin 1 at a shallow angle as it advances through the transparent passage portion 3, the light is reflected according to the raised and depressed pattern of the lower surface of the coin 1. The light reflected from the lower surface of the coin 1 is directed toward the CCD area sensor 12 by the lens system 11 and photoelectrically detected by the CCD area sensor 12, whereby the CCD area sensor 12 produces the analog pattern data corresponding to the pattern of the lower surface of the coin 1.

The analog pattern data of the coin 1 produced by the CCD area sensor 12 are input to the A/D converter 32 to produce digitized pattern data of the lower surface of the coin 1. The pattern data of the coin 1 produced by the A/D converter 32 by digitizing the analog pattern data are input to the diameter data producing means 33 and diameter data of the coin 1 are produced by the diameter data producing means 33 and output to the second denomination determining means 34.

The second denomination determining means 34 reads the reference diameter data of coins of each denomination stored in the reference data memory 30, compares the thus read reference diameter data with the diameter data of the coin 1 produced by the diameter data producing means 33, thereby determining the denomination of the coin 1, and outputs a denomination determination signal to the denomination discriminating means 36. In this embodiment, since the amount of light emitted from the respective light emitting elements 9 is controlled in accordance with the amount of light reflected by the coin 1 and detected by the reflected light sensor 8, the amount of light detected by the CCD area sensor 12 can be prevented from becoming either too small or too large and saturated, whereby failure to produce accurate pattern data of the coin 1 can be prevented. Therefore, since a clear image of the coin 1 can be produced, the second denomination determining means 34 can determine the denomination of the coin 1 with high accuracy based on the diameter data of the coin 1.

On the other hand, the pattern data of the coin 1 produced by the A/D converter 32 by digitizing the analog pattern data are also output to the pattern data producing means 35 and the pattern data producing means 35 produces surface pattern data of the coin 1 based on the pattern data of the coin 1 input from the A/D converter 32 and outputs them to the denomination discriminating means 36.

The denomination discriminating means 36 compares the denomination determination signal input from the first denomination determining means 31 and the denomination determination signal input from the second denomination determining means 34, discriminates that the coin 1 is an unacceptable coin when the denominations determined by the first denomination determining means 31 and the second denomination determining means 34 do not coincide, and outputs an unacceptable coin detection signal to a display means (not shown), thereby causing it to display that an unacceptable coin was detected.

To the contrary, when the denomination determination signal input from the first denomination determining means 31 and the denomination determination signal input from the second denomination determining means 34 coincide, the denomination discriminating means 36 discriminates that the coin 1 is an acceptable coin, reads the reference pattern data of coins of the denomination corresponding to that determined by the first denomination determining means 31 and the second denomination determining means 34 from the reference data memory 30, and compares the thus read reference pattern data with the pattern data of the coin 1 input from the pattern data producing means 35 by the pattern matching, thereby finally discriminating the denomination of the coin 1. In this embodiment, since the amount of light emitted from the respective light emitting elements 9 is controlled in accordance with the amount of light reflected by the coin 1 and detected by the reflected light sensor 8, the amount of light detected by the CCD area sensor 12 can be prevented from becoming either too small or too large and saturated, whereby failure to produce accurate pattern data of the coin 1 can be prevented.

Therefore, since a clear image of the coin 1 can be produced, it is possible to discriminate the denomination of the coin 1 with high accuracy based on the pattern matching of the pattern data of the coin 1 and the reference pattern data.

The pattern matching between the pattern data of the coin 1 produced by the pattern data producing means 35 and the reference pattern data can be preferably effected using the method taught by U.S. Pat. No. 5,538,123.

Coins discriminated as acceptable and coins discriminated as unacceptable are separately collected.

According to the above described embodiment, in accordance with the amount of light reflected by the coin 1 and detected by the reflected light sensor 8, when the reflected light amount data of the coin 1 exceed the reference reflected light amount data, it is judged either that the coin 1 is made of a material having high light reflectivity such as nickel, aluminum or the like and is not so damaged or that the coin 1 has high light reflectivity despite being made of a material having low light reflectivity such as copper, brass or the like, because it has not been in circulation for a long time. In such a case, the light amount determining means 37 outputs a light amount determination signal instructing the light emission control means 20 to control the light amount emitted from the light emitting elements 9 to a low level. To the contrary, in accordance with the amount of light reflected by the coin 1 and detected by the reflected light sensor 8, when the reflected light amount data of the coin 1 are less than the reference reflected light amount data, it is judged either that the the coin 1 has low light reflectivity despite being made of a material having high light reflectivity such as nickel, aluminum or the like because it has been in circulation for a long time, or that the light reflectivity of the coin 1 is low since the coin 1 is made of a material having low light reflectivity such as copper, brass or the like and has been in circulation for a long time. In such a case, the light amount determining means 37 outputs a light amount determination signal instructing the light emission control means 20 to control the light amount emitted from the light emitting elements 9 to a high level. As a result, the light emission control means 20 controls the light emitting elements 9 in accordance with the light amount determination signal input from the light amount determining means 37 so as to cause them emit a low amount of light or a high amount of light. Therefore, the amount of light detected by the CCD area sensor can be prevented from becoming either too small or too large and saturated, whereby failure to produce accurate pattern data of the coin 1 can be prevented. Therefore, a clear image of the coin 1 can be produced. As a consequence, the second denomination determining means 34 can determine the denomination of the coin 1 with high accuracy based on the diameter data of the coin 1 and also discriminate the denomination of the coin 1 with high accuracy based on the pattern matching of the pattern data of the coin 1 and the reference pattern data.

Figure 4:
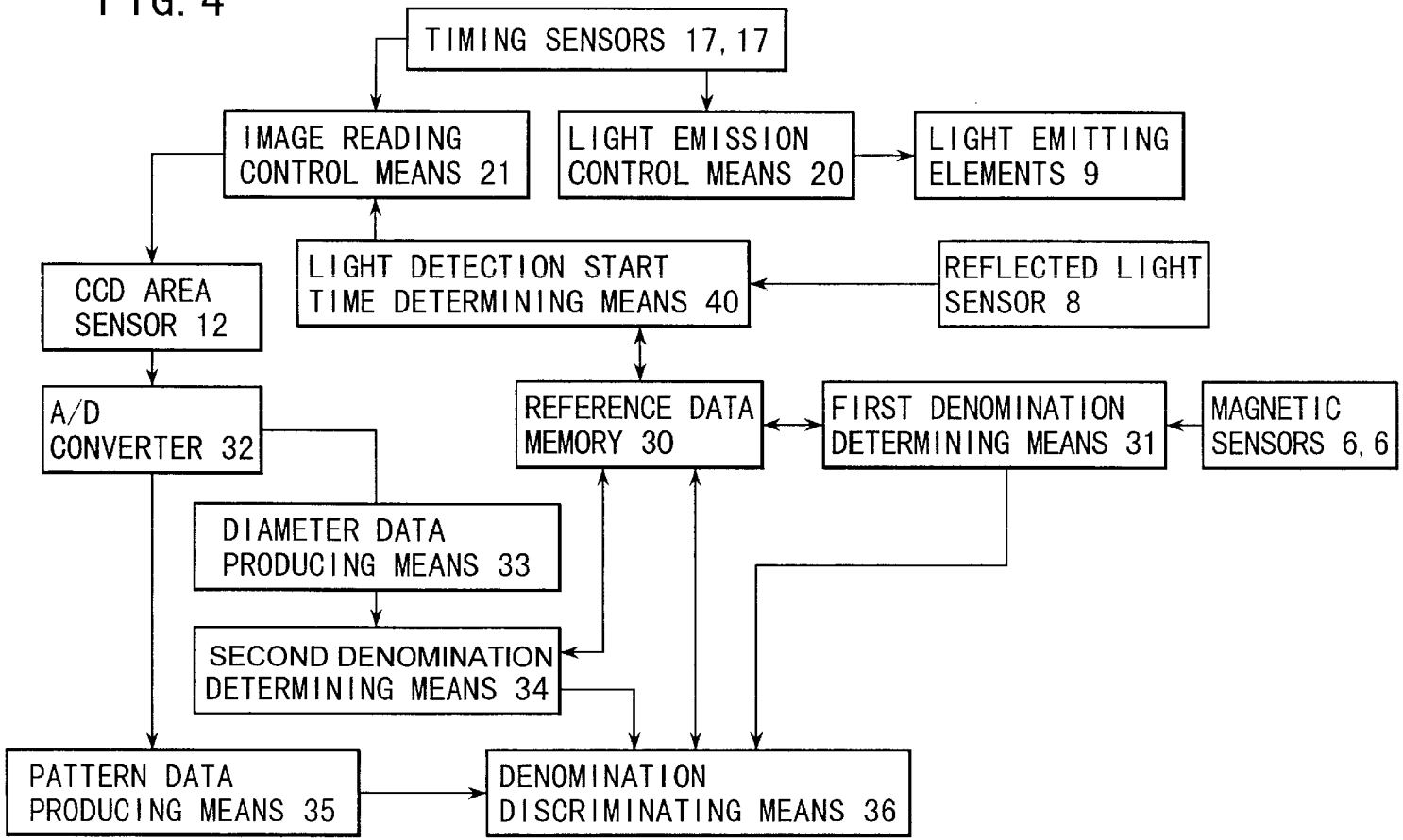
FIG. 4 is a block diagram of a detection system, a control system and a discrimination system of a coin discriminating apparatus which is another preferred embodiment of the present invention.

FIG. 4 is a block diagram of a detection system, a control system and a discrimination system of a coin discriminating apparatus which is another preferred embodiment of the present invention.

As shown in FIG. 4, the discrimination system of the coin discriminating apparatus according to this embodiment includes light detection start time determining means 40 instead of the light amount determining means 37 and the light detection start time determining means 40 is constituted so as to output a reading start time determination signal to the image reading control means 21 based on the amount of light reflected by the coin 1 and detected by the reflected light sensor 8 and control the start time at which it causes the CCD area sensor 12 of the image data producing unit 10 to detect light reflected by the lower surface of the coin 1.

The thus constituted coin discriminating apparatus discriminates whether or not the coin is acceptable and the denomination of the coin 1 when it is acceptable in the following manner.

The coin 1 is fed in the coin passage 2 along the pair of guide rails 5, 5 in the direction indicated by the arrow A, while being pressed onto the surface of the coin passage 2 by the transporting belt 4, and the magnetic properties of the coin 1 are detected by the pair of magnetic sensors 6, 6.

When the magnetic sensors 6, 6 detect the magnetic properties of the coin 1, they output detection signals to the first denomination determining means 31. The first denomination determining means 31 compares the magnetic data of the coin 1 input from the magnetic sensors 6, 6 with the reference magnetic data of coins of each denomination stored in the reference data memory 30, determines the denomination of the coin 1 and outputs a denomination determination signal to the denomination discriminating means 36.

On the other hand, the light source 7 is maintained constantly on and when the coin 1 is fed to the transparent passage portion 3, a local region of the coin 1 is illuminated with light emitted from the light source 7. Light reflected by the illuminated part of the coin 1 is received by the reflected light sensor 8 and a reflected light detection signal is output to the light detection start time determining means 40.

When the light detection start time determining means 40 receives the reflected light detection signal, it reads the reference reflected light amount data from the reference data memory 30 and compares the reflected light amount data of the coin 1 detected by the reflected light sensor 8 with the thus read reference reflected light amount data.

When the reflected light amount data of the coin 1 detected by the reflected light sensor 8 are less than the reference reflected light amount data, it can be judged either that the coin 1 has low light reflectivity despite being made of a material having high light reflectivity such as nickel, aluminum or the like, because it is damaged due to long circulation, or that the light reflectivity of the coin 1 is low since the coin 1 is made of a material having low light reflectivity such as copper, brass or the like and has been in circulation for a long time. Therefore, the light detection start time determining means 40 outputs a reading start time determination signal to the image reading control means 21, thereby causing it to output an image reading start signal to the CCD area sensor 12 of the image data producing unit 10 immediately after the timing sensors 17, 17 detect the coin 1 and detection signals are input from the timing sensors 17, 17 and to instruct the CCD area sensor 12 to start detecting light reflected by the lower surface of the coin 1.

To the contrary, when the reflected light amount data of the coin 1 detected by the reflected light sensor 8 exceed the reference reflected light amount data, it can be judged either that the coin 1 is made of a material having high light reflectivity such as nickel, aluminum or the like and is not so damaged, or that the coin 1 has high light reflectivity despite being made of a material having low light reflectivity such as copper, brass or the like, because it has not been in circulation for a long time. Therefore, the light detection start time determining means 40 outputs a reading start time determination signal to the image reading control means 21, thereby causing it to output an image reading start signal to the CCD area sensor 12 of the image data producing unit 10 when a predetermined time period has passed after the timing sensors 17, 17 detect the coin 1 and detection signals are input from the timing sensors 17, 17 and to instruct the CCD area sensor 12 to start detecting light reflected by the lower surface of the coin 1.

When the coin 1 has reached the transparent passage portion 3 and the timing sensors 17, 17 detect the coin 1, timing signals are output to the light emission control means 20 and the image reading control means 21.

As a result, in accordance with the reading start time determination signal input from the light detection start time determining means 40, the image reading control means 21 immediately outputs the image reading start signal to the CCD area sensor 12 of the image data producing unit 10, thereby causing it to start detecting light reflected by the lower surface of the coin 1, or outputs the image reading start signal to the CCD area sensor 12 of the image data producing unit 10 when a predetermined time period has passed, thereby causing it to start detecting light reflected by the lower surface of the coin 1.

Since each light emitting element 9 is disposed so as to be able to illuminate the coin 1 at a shallow angle as it advances through the transparent passage portion 3, the light is reflected according to the raised and depressed pattern of the lower surface of the coin 1. The light reflected from the lower surface of the coin 1 is directed toward the CCD area sensor 12 by the lens system 11 and photoelectrically detected by the CCD area sensor 12, whereby the CCD area sensor 12 produces the analog pattern data corresponding to the lower surface of the coin 1.

The analog pattern data of the coin 1 produced by the CCD area sensor 12 are input to the A/D converter 32 to produce digitized pattern data of the lower surface of the coin 1. The pattern data of the coin 1 produced by the A/D converter 32 by digitizing the analog pattern data are input to diameter data producing means 33 and the diameter data of the coin 1 are produced by the diameter data producing means 33 and output to the second denomination determining means 34.

The second denomination determining means 34 reads the reference diameter data of coins of each denomination stored in the reference data memory 30, compares the thus read reference diameter data with the diameter data of the coin 1 produced by the diameter data producing means 33, thereby determining the denomination of the coin 1, and outputs a denomination determination signal to the denomination discriminating means 36. In this embodiment, since the time at which the CCD area sensor 12 starts detecting light reflected by the lower surface of the coin 1 is controlled in accordance with the amount of light reflected by the coin 1 and detected by the reflected light sensor 8, the amount of light detected by the CCD area sensor 12 can be prevented from becoming either too small or too large and saturated, whereby failure to produce accurate pattern data of the coin 1 can be prevented. Therefore, since a clear image of the coin 1 can be produced, the second denomination determining means 34 can determine the denomination of the coin 1 with high accuracy based on the diameter data of the coin 1.

On the other hand, the pattern data of the coin 1 produced by the A/D converter 32 by digitizing the analog pattern data are also output to the pattern data producing means 35 and the pattern data producing means 35 produces surface pattern data of the coin 1 based on the pattern data of the coin 1 input from the A/D converter 32 and outputs them to the denomination discriminating means 36.

The denomination discriminating means 36 compares the denomination determination signal input from the first denomination determining means 31 and the denomination determination signal input from the second denomination determining means 34, discriminates that the coin 1 is an unacceptable coin when the denominations determined by the first denomination determining means 31 and the second denomination determining means 34 do not coincide and outputs an unacceptable coin detection signal to a display means (not shown), thereby causing it to display that an unacceptable coin was detected.

To the contrary, when the denomination determination signal input from the first denomination determining means 31 and the denomination determination signal input from the second denomination determining means 34 coincide, the denomination discriminating means 36 discriminates that the coin 1 is an acceptable coin, reads the reference pattern data of coins of the denomination corresponding to that determined by the first denomination determining means 31 and the second denomination determining means 34 from the reference data memory 30, and compares the thus read reference pattern data with the pattern data of the coin 1 input from the pattern data producing means 35 by the pattern matching, thereby finally discriminating the denomination of the coin 1. In this embodiment, since the time at which the CCD area sensor 12 starts detecting light reflected by the lower surface of the coin 1 is controlled in accordance with the amount of light reflected by the coin 1 and detected by the reflected light sensor 8, the amount of light detected by the CCD area sensor 12 can be prevented from becoming either too small or too large and saturated, whereby failure to produce accurate pattern data of the coin 1 can be prevented. Therefore, since a clear image of the coin 1 can be produced, it is possible to discriminate the denomination of the coin 1 with high accuracy based on the pattern matching of the pattern data of the coin 1 and the reference pattern data.

The pattern matching between the pattern data of the coin 1 produced by the pattern data producing means 35 and the reference pattern data can be preferably effected using the method taught by U.S. Pat. No. 5,538,123.

Coins discriminated as acceptable and coins discriminated as unacceptable are separately collected.

According to the above described embodiment, in accordance with the amount of light reflected by the coin 1 and detected by the reflected light sensor 8, when the reflected light amount data of the coin 1 are less than the reference reflected light amount data, it is judged either that the coin 1 has low light reflectivity despite being made of a material having high light reflectivity such as nickel, aluminum or the like, because it has been in circulation for a long time, or that the light reflectivity of the coin 1 is low since the coin 1 is made of a material having low light reflectivity such as copper, brass or the like and has been in circulation for a long time. In such a case, the light detection start time determining means 40 outputs a reading start time determination signal to the image reading control signal 21 to instruct it to output an image reading start signal to the CCD area sensor 12 of the image data producing unit 10 immediately after the timing sensors 17, 17 detect the coin 1 and detection signals are input from the timing sensors 17, 17 and to cause the CCD area sensor 12 to immediately start detecting light reflected from the lower surface of the coin 1 at the time the timing sensors 17, 17 detect the coin 1. To the contrary, in accordance with the amount of light reflected by the coin 1 and detected by the reflected light sensor 8, when the reflected light amount data of the coin 1 exceed the reference reflected light amount data, it is judged either that the coin 1 is made of a material having high light reflectivity such as nickel, aluminum or the like and is not so damaged, or that the coin 1 has high light reflectivity despite being made of a material having low light reflectivity such as copper, brass or the like, because it has not been in circulation for a long time. In such a case, the light detection start time determining means 40 outputs a reading start time determination signal to the image reading control signal 21 to instruct it to output an image reading start signal to the CCD area sensor 12 of the image data producing unit 10 when a predetermined time period has passed after the timing sensors 17, 17 detect the coin 1 and detection signals are input from the timing sensors 17, 17 and to cause the CCD area sensor 12 to start detecting light reflected by the lower surface of the coin 1 when a predetermined time period has passed after the timing sensors 17, 17 detect the coin 1 and detection signals are input from the timing sensors 17, 17. Therefore, the amount of light to be detected by the CCD area sensor 12 can be prevented from becoming either too little or too large and saturated, whereby failure to produce accurate pattern data of the coin 1 can be prevented and a clear image of the coin 1 can be produced. As a consequence, the second denomination determining means 34 can determine the denomination of the coin 1 with high accuracy based on the diameter data of the coin 1 and discriminate the denomination of the coin 1 with high accuracy based on the pattern matching of the pattern data of the coin 1 and the reference pattern data.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, in accordance with the amount of light reflected by the coin 1 and detected by the reflected light sensor 8, when the reflected light amount data of the coin 1 are less than the reference reflected light amount data, the intensity of light emitted from the light emitting elements 9 is controlled to a high level or the CCD area sensor 12 is caused to start detecting light reflected by the lower surface of the coin 1 immediately after the timing sensors 17, 17 detect the coin 1. On the other hand, in accordance with the amount of light reflected by the coin 1 and detected by the reflected light sensor 8, when the reflected light amount data of the coin 1 exceed the reference reflected light amount data, the intensity of light emitted from the light emitting elements 9 is controlled to a low level or the CCD area sensor 12 is caused to start detecting light reflected by the lower surface of the coin 1 when a predetermined time has passed after the timing sensors 17, 17 detect the coin 1. However, the intensity of light emitted from the light emitting elements 9 may be controlled over three or more stages or the time at which the CCD area sensor 12 starts detecting light reflected by the lower surface of the coin 1 may be controlled over three or more stages by, for example, storing first reference reflected light amount data and second reference reflected light amount data in the reference data memory 30, controlling the intensity of light emitted from each light emitting element 9 to be I1 or causing the CCD area sensor 12 to start detecting light reflected by the lower surface of the coin 1 immediately after the timing sensors 17, 17 detect the coin 1 if the reflected light amount data is equal to or less than the second reference reflected light amount data smaller than the first reference reflected light amount data, controlling the intensity of light emitted from each light emitting element 9 to be I2 (which is smaller than I1) or causing the CCD area sensor 12 to start detecting light reflected by the lower surface of the coin 1 when a predetermined time T1 has passed after the timing sensors 17, 17 detect the coin 1 if the reflected light amount data exceed the second reference reflected light amount data and are equal to or smaller than the first reference reflected light amount data, or controlling the intensity of light emitted from each light emitting element 9 to be 13 (which is smaller than I2) or causing the CCD area sensor 12 to start detecting light reflected by the lower surface of the coin 1 when a predetermined time T2 (which is longer than T1) has passed after the timing sensors 17, 17 detect the coin 1 if the reflected light amount data exceed the first reference reflected light amount data.

Further, in the above described embodiments, the intensity of light emitted from each light emitting element 9 is controlled or the time at which the CCD area sensor 12 starts detecting light reflected by the lower surface of the coin 1 is controlled based on the amount of light reflected by the coin 1 and detected by the reflected light sensor 8. However, the intensity of light emitted from each light emitting element 9 may be controlled or the time at which the CCD area sensor 12 starts detecting light reflected by the lower surface of the coin 1 may be controlled by discriminating the material of the coin 1 based on magnetic properties of the coin 1 detected by the magnetic sensors 6, 6 and depending upon the material of the coin 1 and the amount of light reflected by the coin 1 and detected by the reflected light sensor 8.

Furthermore, although the light source 7 is maintained constantly on, the light source 7 may be turned on only when the coin 1 has reached a predetermined position by providing a timing sensor for detecting the coin 1.

Moreover, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin discriminating apparatus capable for discriminating whether or not coins are acceptable and the denominations of coins with high accuracy by optically detecting the surface patterns of coins.

We claim:

1. A coin discriminating apparatus comprising:

a light source for emitting light toward one surface of a coin being transported, reflected light sensor means for receiving light emitted from the light source and reflected by the coin, light emitting means disposed downstream of the light source with respect to a transportation direction of the coin for emitting light toward the one surface of the coin being transported, sensor means for photoelectrically receiving light emitted from the light emitting means and reflected by the one surface of the coin and producing image pattern data of the one surface of the coin, reference data storing means for storing reference data of coins of each denomination, first denomination determining means for calculating coin diameter based on the image pattern data of the one surface of the coin produced by the sensor means, comparing the thus calculated diameter of the coin with reference diameter data of coins of each denomination stored in the reference data storing means and tentatively determining the denomination of the coin, denomination discriminating means for reading reference pattern data of coins of the denomination determined by the first denomination determining means from the reference data storing means, comparing the thus read reference pattern data with the image pattern data of the one surface of the coin and finally determining the denomination of the coin, and received light amount control means for controlling an amount of light reflected by the one surface of the coin to be detected by the sensor means in accordance with an amount of light reflected by the coin and detected by the reflected light sensor means.

2. A coin discriminating apparatus in accordance with claim 1 wherein the received light amount control means is constituted so as to control the intensity of light emitted from the light emitting means in accordance with the amount of light reflected from the coin and detected by the reflected light sensor means.

3. A coin discriminating apparatus in accordance with claim 2 which further comprises magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

4. A coin discriminating apparatus in accordance with claim 2 wherein the received light amount control means is constituted so as to control the light emitting means in such a manner that the intensity of light emitted therefrom can be controlled to a high level when the amount of light detected by the reflected light sensor means is small and that the intensity of light emitted therefrom can be controlled to a low level when the amount of light detected by the reflected light sensor means is large.

5. A coin discriminating apparatus in accordance with claim 4 which further comprises magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

6. A coin discriminating apparatus in accordance with claim 1 wherein the received light amount control means is constituted so as to control a time period during which the sensor means photoelectrically detects light reflected by the one surface of the coin in accordance with the amount of light reflected from the coin and detected by the reflected light sensor means.

7. A coin discriminating apparatus in accordance with claim 6 which further comprises magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

8. A coin discriminating apparatus in accordance with claim 6 wherein the received light amount control means is constituted so as to control the sensor means in such a manner that the time period becomes longer when the amount of light detected by the reflected light sensor means is small and that the time period becomes shorter when the amount of light detected by the reflected light sensor means is large.

9. A coin discriminating apparatus in accordance with claim 8 which further comprises magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

10. A coin discriminating apparatus in accordance with claim 1 which further comprises magnetic sensor means for detecting magnetic properties of the coin being transported and the received light amount control means is constituted so as to control an amount of light reflected by the one surface of the coin to be detected by the sensor means in accordance with an amount of light reflected by the coin and detected by the reflected light sensor means and the magnetic properties of the coin detected by the magnetic sensor means.

* * * * *